United States Patent [19]

Reid et al.

[11] Patent Number: 4,804,889

[45] Date of Patent: Feb. 14, 1989

[54] ELECTRODE FEEDTHROUGH ASSEMBLY FOR ARC DISCHARGE LAMP

[75] Inventors: David A. Reid, Annandale, Va.; Roger A. Johnson, Grafton, N.H.; John Gutta, Groverland, Mass.

[73] Assignee: GTE Products Corporation, Danvers, Mass.

[21] Appl. No.: 135,406

[22] Filed: Dec. 18, 1987

[51] Int. Cl.[4] ..... H01J 61/36; H01J 9/32

[52] U.S. Cl. ..... 313/624; 313/625; 313/25; 445/26; 445/44

[58] Field of Search ..... 313/624, 625, 25; 445/26, 44

[56] References Cited

U.S. PATENT DOCUMENTS

| | | | |
|---|---|---|---|
| 3,564,328 | 2/1971 | Bagley et al. | 313/624 |
| 3,609,437 | 9/1971 | De Vrijer | 313/625 |
| 4,147,952 | 4/1979 | Webb et al. | 313/625 |
| 4,464,603 | 8/1984 | McVey | 313/624 |
| 4,545,799 | 10/1985 | Rhodes et al. | 313/623 X |

*Primary Examiner*—Palmer C. DeMeo

*Attorney, Agent, or Firm*—Joseph S. Ramanow

[57] ABSTRACT

A ceramic arc tube assembly for an arc discharge lamp includes an arc tube having openings for electrode feedthroughs at opposite ends. The feedthroughs each comprise a niobium tube having a tungsten electrode welded to it. A connection wire is welded to the feedthrough at or near the end of the niobium tube, and the feedthrough is subsequently sealed into the arc tube with the connection wire abutting the arc tube. Since the connection wire is prewelded to the feedthrough, the feedthrough can be made as short as practicable without risk of damaging the seal during welding. As a result, feedthrough material cost is substantially reduced. Preferably, the connection wire is used for locating the feedthrough in the arc tube during seal formation.

18 Claims, 2 Drawing Sheets

ELECTRODE FEEDTHROUGH ASSEMBLY FOR ARC DISCHARGE LAMP

Field of the Invention

This invention relates to ceramic arc tube assemblies for high pressure arc discharge lamps and, more particularly, to electrode feedthrough structures and methods of fabrication.

BACKGROUND OF THE INVENTION

High pressure sodium arc lamps have been in commercial production for many years and have been subject to many improvements in design, materials and processing. Such lamps include a translucent ceramic tube, an outer envelope including an electrical connector, and a frame for supporting the arc tube within the outer envelope. The frame is electrically conductive and carries power to the arc tube. The arc tube is typically fabricated from polycrystalline alumina or yttria and contains an amalgam of mercury and sodium for producing light having a desired output spectrum. Tungsten or molybdenum electrodes are positioned within the arc tube at opposite ends and are attached to feedthroughs selected to have thermal expansion characteristics closely matched to those of the ceramic tube. The feedthroughs are hermetically sealed in openings at opposite ends of the arc tube. Niobium, usually containing one percent zirconium by weight, is the Preferred feedthrough material for alumina arc tubes.

A variety of electrode feedthrough structures and techniques for hermetically sealing the feedthrough to the arc tube are known in the art. In one widely-used structure, the feedthrough is a niobium tube and the tungsten electrode is welded to one end of the tube. The opening in the end of the arc tube is sufficiently large for insertion of the electrode, and a tube is used to reduce stresses due to thermal expansion mismatches and to limit material costs. Typically, a ceramic ring is sealed to the end of the arc tube over the feedthrough to extend the length of the seal and to improve its reliability. Such a structure is disclosed in U.S. Pat. No. 4,539,511. The niobium tube with the electrode attached is sealed in the opening in the end of the arc tube with a suitable sealing frit. A region of the niobium tube close to the arc tube becomes wetted with the frit material. The end of the niobium feedthrough outside the arc tube is welded to the lamp frame or to a wire that is attached to the lamp frame. In the prior art, the welding of the feedthrough to the lamp frame often produced cracking of the seal between the feedthrough and the arc tube unless the niobium tube was extended in length so that the welded connection between the tube and the lamp frame was spaced from the hermetic seal. While this structure provides satisfactory performance, it is relatively expensive because of the material used in the extended length of niobium tube.

High pressure discharge lamps utilizing tubular electrode feedthroughs are disclosed in U.S. Pat. Nos. 4,545,799 to Rhodes et al; 4,539,511 to Denbigh et al; 4,019,078 to Burgess; and 4,501,799 to Driessen et al. A discharge lamp utilizing a solid rod for an electrode feedthrough is disclosed in U.S. Pat. No. 4,101,799 to Wiedijk et al. Naturally, more material is utilized in a solid rod, thereby increasing the material cost.

Another feedthrough structure known in the prior art utilizes a niobium wire sealed in an opening in the arc tube and connected to the tungsten electrode. The niobium wire is smaller in diameter than the electrode and the electrode will not pass through the opening in the end of the arc tube. In this case, the niobium wire and electrode must be sealed into a ceramic end plug which is then sealed to the end of the arc tube, as shown in U.S. Pat. No. 4,199,704 to Varshneya et al. This arrangement requires a seal not only between the niobium wire and the end plug, but also between the end plug and the ceramic tube. The seal between the end plug and the arc tube is extremely difficult to make and has inherent problems. Stresses occurring in this design create cracks in the seal area and subsequent lamp defects.

It is desirable to provide a ceramic arc tube assembly having an electrode feedthrough structure with reduced cost relative to prior art structures, while providing a reliable, long-life seal.

It is a general object of the present invention to provide improved ceramic arc tube assemblies for high pressure discharge lamps.

It is another object of the present invention to provide an electrode feedthrough structure for a ceramic arc tube assembly wherein the quantity of material used in the feedthrough is reduced.

It is still another object of the present invention to provide a ceramic arc tube assembly which is low in cost and easy to manufacture.

It is a further object of the present invention to provide a ceramic arc tube assembly that is easily attached to a lamp frame.

It is still another object of the present invention to provide a ceramic arc tube assembly having a long operating life.

SUMMARY OF THE INVENTION

According to the present invention, these and other objects and advantages are achieved in a ceramic arc tube assembly comprising a ceramic arc tube having an opening in at least one end, an electrode feedthrough sealed in the opening and a connection wire attached to the electrode feedthrough adjacent to the end of the arc tube for electrical connection between the electrode feedthrough and a lamp frame. The connection wire is attached to the electrode feedthrough at or near the end thereof. The electrode feedthrough has an electrode coupled to it, and the opening in the arc tube is of sufficient size to permit passage of the electrode.

In the arc tube assembly of the invention, the feedthrough is substantially shortened in comparison with prior art feedthrough structures, and feedthrough material cost is reduced. Preferably, the feedthrough is a niobium tube and the connection wire is niobium. The connection wire is welded to the niobium tube prior to sealing of the feedthrough into the ceramic arc tube. As a result, the problem of seal cracking caused by welding close to the sealing area is eliminated. The opposite end of the connection wire is welded to the lamp frame after completion of the arc tube assembly.

Preferably, the connection wire is positioned on the feedthrough to act as a locator during sealing. The wire is in abutment with the end of the arc tube, and the extension of the feedthrough beyond the arc tube is minimized.

The electrode feedthrough structure of the present invention can be utilized with arc tube assemblies utilizing a ceramic sealing ring, with those having only a ceramic insert or an integral end wall and with those using ceramic end caps directly sealed to the arc tube without a sealing material.

In accordance with another aspect of the invention, a method for fabricating a ceramic arc tube assembly comprises the steps of providing a ceramic arc tube having an opening in at least one end, providing an electrode feedthrough that is sized to fit in the opening in the arc tube, welding a connection wire to the electrode feedthrough at or near one end thereof and, subsequent to the welding step, sealing the electrode feedthrough into the opening in the arc tube. Preferably, the electrode feedthrough is inserted into the opening in the arc tube with the connection wire abutting the end of the arc tube. After the feedthrough is sealed into the arc tube, the connection wire is welded to a lamp frame. The weld between the connection wire and the lamp frame, which is made during frame mounting, is a simple wire-to-wire weld. Such a weld is easier than the wire-to-tube weld necessary with the prior art.

BRIEF DESCRIPTION OF THE DRAWINGS

For a better understanding of the present invention together with other and further objects, advantages and capabilities thereof, reference is made to the accompanying drawings which are incorporated herein by reference and in which.

DESCRIPTION OF THE PRIOR ART

Figure 1:
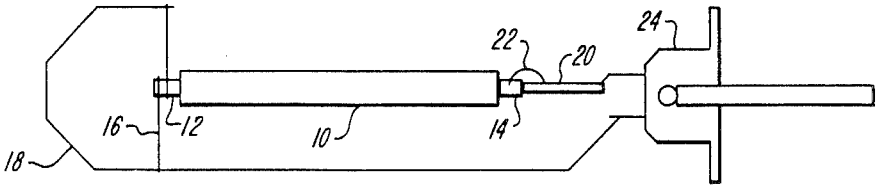
FIG. 1 (PRIOR ART)
FIG. 1 illustrates an arc tube assembly and lamp frame structure in accordance with the prior art.

An arc tube and lamp frame assembly in accordance with the prior art is illustrated in simplified form in FIG. 1. A ceramic arc tube 10, typically of polycrystalline alumina, has niobium electrode feedthroughs 12 and 14 sealed into opposite ends. At one end, a wire 16 is wrapped around feedthrough 12 and welded to it. Wire 16 is welded at opposite ends to a frame member 18. A support rod 20 is inserted into feedthrough 14, and a connecting wire 22 is welded between feedthrough 14 and support rod 20. Frame member 18 and support rod 20 are coupled to a lamp stem 24 in a conventional manner. Niobium feedthroughs 12 and 14 have conventionally been fabricated so as to extend beyond the ends of arc tube 10 by about 6 mm, in order to permit welding to wires 16 and 22 without damaging the arc tube seals.

DETAILED DESCRIPTION OF THE INVENTION

Figure 2:
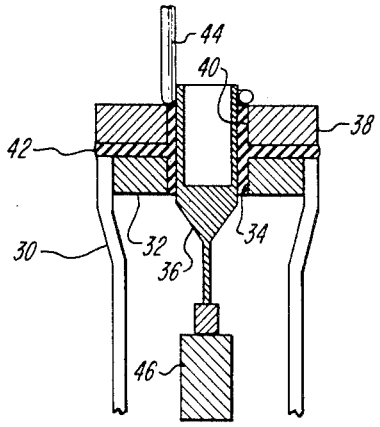
FIG. 2 is a cross-sectional view of one end of an arc tube assembly in accordance with the present invention.

A cross-sectional view of one end of an arc tube assembly in accordance with the present invention is shown in FIG. 2. The opposite end of the arc tube assembly is typically identical after completion of the lamp fabrication process. The arc tube assembly is typically utilized in a high pressure sodium arc discharge lamp, but may be utilized in any lamp requiring a translucent ceramic arc tube. A ceramic arc tube 30 has a generally cylindrical shape and has an end member 32 sealed to each end. End member 32 may be integral with the wall of arc tube 30, may be directly sealed to arc tube 30 as disclosed in U.S. Pat. No. 4,545,799 or may be sealed with an appropriate sealing frit. End member 32 includes a centrally-located opening 34 for an electrode feedthrough 36. A sealing ring 38 is positioned over end member 32 and has an opening 40 aligned with opening 34. Electrode feedthrough 36 extends through opening 40 in sealing ring 38 and opening 34 in end member 32. A sealing frit 42 is located in the annular region between end member 32 and feedthrough 36, the annular region between sealing ring 38 and feedthrough 36 and between end member 32 and sealing ring 38 to provide a reliable seal of the arc tube assembly. The end of feedthrough 36 which is outside the arc tube 30 is welded to a refractory connection wire 44. The opposite end of feedthrough 36 inside arc tube 30 is welded to a tungsten electrode 46.

Preferably, the arc tube 30, end member 32 and sealing ring 38 are polycrystalline alumina, and the feedthrough 36 is a niobium tube. Alternatively, the ceramic members 30, 32, 38 can be yttria or another suitable material. The openings 34 and 40 are of sufficient diameter to permit insertion of electrode 46 into the arc tube assembly. In accordance with the present invention, the tubular niobium feedthrough 36 is substantially reduced in length in comparison with prior art feedthroughs. The wire 44 provides electrical connection to the lamp frame and, when desired, also provides mechanical support for the arc tube assembly. The feedthrough 36 extends beyond sealing ring 38 only by an amount sufficient for connection of wire 44. The feedthrough 36 can extend further, but such extension is not functional and only adds to cost. In a preferred embodiment, the connection wire 44 is niobium or a material of similar thermal expansion coefficient.

To prevent damage to the lamp seal when the wire 44 is welded to the feedthrough 36, the welding process is performed before the sealing of the feedthrough 36 into the arc tube assembly. Therefore, the connection wire 44 becomes a part of the arc tube assembly. In the embodiment of FIG. 2, the wire 44 is wrapped circumferentially around tubular feedthrough 36 approximately one-half turn as close to the end of the feedthrough as is practical and is welded in place.

According to another aspect of the invention, the connection wire 44 can be utilized for feedthrough location during fabrication of the arc tube assembly. It is known in the prior art to attach one or more lengths of niobium wire to the tubular electrode feedthrough 36 at a prescribed location in order to properly locate the feedthrough 36 relative to the sealing ring 38. The feedthrough 36 is inserted into the arc tube assembly until the locator wire or wires abut against the sealing ring 38, and the feedthrough 36 is sealed to the arc tube. In the present invention, the connection wire 44 is preferably utilized to locate the feedthrough 36 during the fabrication process. After welding of the connection wire 44 to feedthrough 36, the feedthrough 36 is inserted into the arc tube assembly until wire 44 abuts against sealing ring 38. Then, the seal between the arc tube and the feedthrough is formed.

Figure 3:
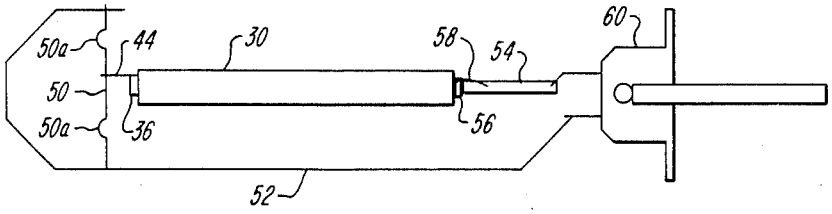
FIG. 3 illustrates a ceramic arc tube assembly and lamp frame structure in accordance with the present invention.

An arc tube assembly utilizing shortened feedthroughs and prewelded connection wires in accordance with the present invention is shown installed in a lamp frame in FIG. 3. At one end of arc tube 30, the connection wire 44 is attached to feedthrough 36 as described hereinabove. The opposite end of connection wire 44 is welded to a crossover wire 50 having thermal expansion shapes 50*a*. The crossover wire 50 is welded at opposite ends to an appropriately-shaped lamp frame member 52. At the opposite end of arc tube 30, a support rod 54 is inserted into a tubular niobium feedthrough 56 fabricated in the same manner as feedthrough 36. A connection wire 58 is welded to feedthrough 56 as shown in FIG. 2 and is welded at its opposite end to support rod 54. Frame member 52 and support rod 54 are coupled to a lamp stem 60 in conventional manner. The completed high pressure discharge lamp includes an outer envelope and an electrical connector (not shown).

The arc tube construction shown and described hereinabove provides numerous advantages in the fabrication of the high pressure discharge lamps. First, the lamp cost is reduced because the quantity of relatively-expensive niobium used in the feedthroughs is substantially reduced. In a preferred embodiment, the niobium feedthrough tube was reduced in length from a 6 mm extension beyond the end of the arc tube in a prior art lamp to a 3 mm extension beyond the end of the arc tube in accordance with the present invention, and the feedthrough material cost was reduced by 15 percent. The seal integrity is maintained since the connection wire 44 is welded to the feedthrough 36 prior to sealing the feedthrough into the arc tube assembly. The arc tube assembly can easily be adapted for use in different lamp frame structures simply by lengthening, shortening or otherwise altering the connection wire 44. As described above, the connection wire 44 can be utilized for locating the feedthrough 36 in the arc tube assembly during fabrication. The connection wire configuration is more adaptable to automation in frame mounting than prior configurations. Since a simple wire lead projects from both ends of the arc tube, a single-sided welding operation can be employed to attach the arc tube to the frame, thereby reducing cost of machinery and automation. The connection wire is welded to the feedthrough during the arc tube assembly, and the connection wire is welded to the lamp frame during frame mounting. The weld which is performed during frame mounting is a simple wire-to-wire weld, and the overall assembly process is simplified in comparison with the prior art.

Figure 4A:
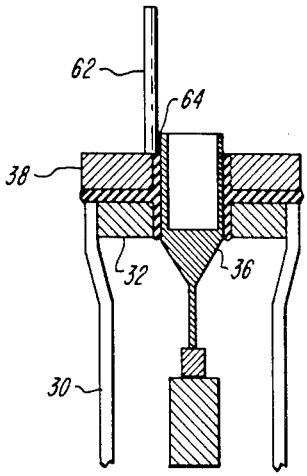
FIGS. 4A–4C illustrate alternate connection wire configurations in accordance with the present invention.
Figure 4B:
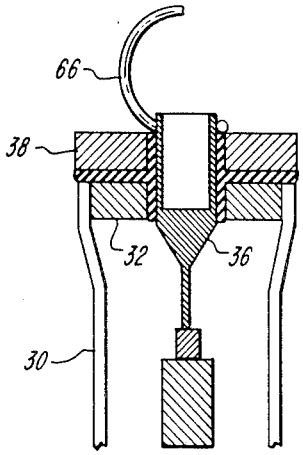
Figure 4C:
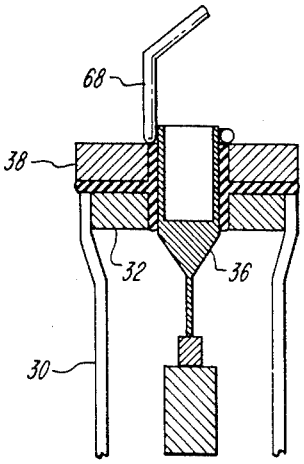

It will be understood by those skilled in the art that various modifications are included within the scope of the present invention. A straight connection wire 62 welded to feedthrough 36 at point 64 is illustrated in FIG. 4A. A curved connection wire 66 is illustrated in FIG. 4B, and a bent connection wire 68 is illustrated in FIG. 4C. The curved and bent configurations permit expansion and contraction during lamp operation without excessive stress on lamp components.

Figure 4D:
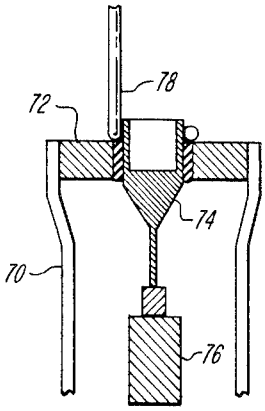
FIG. 4D illustrates the use of the electrode feedthrough structure of the present invention in an arc tube with an end insert and no sealing ring.
Figure 4E:
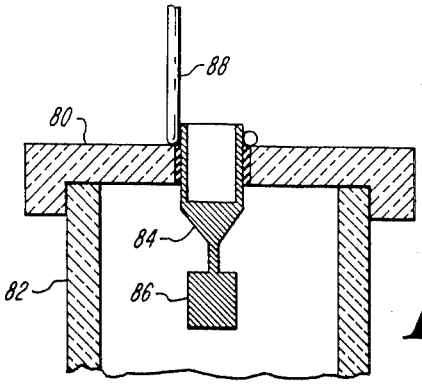
FIG. 4E illustrates the use of the electrode feedthrough structure of the present invention in an arc tube with a directly-sealed end cap.

It will also be understood that the present invention is not limited to the arc tube construction shown in FIG. 2, but can be utilized in any arc tube assembly. An arc tube assembly in which the sealing ring is eliminated is shown in FIG. 4D. An arc tube 70 has an end member 72 which may be integral with arc tube 70 or may be sealed in the end thereof with or without the use of a sealing material. An electrode feedthrough 74 is welded at one end to a tungsten electrode 76, and a connection wire 78 is welded to feedthrough 74 at or near the end of the opposite end. A configuration utilizing an end cap 80 directly sealed to an arc tube 82 is shown in FIG. 4E. The end cap 80 is sealed to arc tube 82 without the use of a sealing material by a suitable sintering procedure, as known in the prior art. An electrode feedthrough 84 with a tungsten electrode 86 welded thereto is sealed in an opening in end cap 80. A connection wire 88 is welded at or near the end of feedthrough tube 84. In FIGS. 4D and 4E, the respective connection wires 78 and 88 are welded to the feedthroughs 74 and 84, respectively, prior to sealing of the feedthroughs into the arc tube assembly, thereby permitting the use of shortened feedthroughs without compromising the integrity of the lamp seal.

While there has been shown and described what is at present considered the preferred embodiments of the present invention, it will be obvious to those skilled in the art that various changes and modifications may be made therein without departing from the scope of the invention as defined by the appended claims.

What is claimed is:

1. A ceramic arc tube assembly comprising:

a ceramic arc tube having an opening in at least one end;

a ceramic sealing element attached to at least one end of said arc tube and having an opening aligned with the opening in said arc tube;

an electrode feedthrough sealed in the openings in said arc tube and said sealing element, said electrode feedthrough comprising a conductive material closely matched in thermal characteristics to said arc tube; and a connection wire attached to said electrode feedthrough adjacent to the opening in said sealing element for electrical connection between said electrode feedthrough and a lamp frame, said electrode feedthrough not extending substantially beyond the attachment between said wire and said feedthrough.

2. An arc tube assembly as defined in claim 1 wherein said connection wire is attached to said feedthrough so as to locate said feedthrough in said sealing element by abutment between said wire and said sealing element.

3. An arc tube assembly as defined in claim 1 wherein said electrode feedthrough extends beyond said sealing element by an amount not in excess of 3 mm.

4. An arc tube assembly as defined in claim 3 wherein said arc tube and said sealing element comprise polycrystalline alumina and said electrode feedthrough comprises niobium.

5. An arc tube assembly as defined in claim 4 wherein said connection wire comprises niobium or a material of similar thermal expansion coefficient.

6. An arc tube assembly as defined in claim 5 wherein said niobium wire is welded to said electrode feedthrough.

7. An arc tube as defined in claim 4 wherein said electrode feedthrough has a generally tubular configuration.

8. An arc tube as defined in claim 4 wherein said sealing element comprises a ceramic ring sealed to said at least one end of said arc tube.

9. An arc tube as defined in claim 4 wherein said sealing element comprises an end cap directly sealed to said at least one end of said arc tube.

10. An arc tube assembly as defined in claim 7 wherein said connection wire is circumferentially wrapped around said tubular electrode feedthrough and is welded thereto.

11. A ceramic arc tube assembly comprising:

a ceramic arc tube having an opening in at least one end;

a ceramic sealing element attached to at least one end of said arc tube and having an opening aligned with the opening in said arc tube;

an electrode feedthrough sealed into said openings in said arc tube and said sealing element;

an electrode coupled to said electrode feedthrough, said openings being of sufficient size to permit passage of said electrode; and means for locating said electrode feedthrough in said sealing element and for electrical connection between said electrode feedthrough and a lamp frame, comprising a connection wire attached to said electrode feedthrough and abutting said sealing element.

12. An arc tube assembly as defined in claim 11 wherein said electrode feedthrough does not extend substantially beyond the attachment between said connection wire and said electrode feedthrough.

13. An arc tube assembly as defined in claim 11 wherein electrode feedthrough extends beyond said sealing element less than about 3 mm.

14. A method for fabricating a ceramic arc tube assembly comprising the steps of:

providing a ceramic arc tube having an opening in at least one end;

providing an electrode feedthrough that is closely matched in thermal characteristics to said arc tube and sized to fit in the opening in said arc tube;

welding a connection wire to said electrode feedthrough at or near one end thereof; and subsequent to said welding step, sealing said electrode feedthrough into said opening in said arc tube.

15. A method for fabricating a ceramic arc tube assembly as defined in claim 14 further including the step of inserting said electrode feedthrough into the opening in said arc tube with said connection wire abutting the end of said arc tube.

16. A method for fabricating a ceramic arc tube assembly as defined in claim 15 further including the step of welding said connection wire to lamp frame.

17. A ceramic arc tube assembly comprising:

a ceramic arc tube having an opening in at least one end;

an electrode feedthrough sealed in said opening, said electrode feedthrough having an electrode coupled thereto and said opening being of sufficient size to permit passage of said electrode; and a connection wire attached to said electrode feedthrough adjacent to the end of said arc tube for electrical connection between said electrode feedthrough and a lamp frame, said connection wire being attached to said electrode feedthrough at or near the end thereof.

18. A ceramic arc tube assembly as defined in claim 15 wherein said electrode feedthrough is cylindrical and wherein said connection wire abuts against the end of said arc tube.

* * * * *